US012577680B2

(12) United States Patent
Zhang

(10) Patent No.: US 12,577,680 B2
(45) Date of Patent: Mar. 17, 2026

(54) METHOD OF SURFACE FRICTION TREATMENT OF CERAMIC-REINFORCED ALUMINUM MATRIX COMPOSITE BRAKE DISC

(71) Applicant: SHANGHAI REINPHEN COMPOSITE MATERIALS CO., LTD., Shanghai (CN)

(72) Inventor: Dingquan Zhang, Shanghai (CN)

(73) Assignee: SHANGHAI REINPHEN COMPOSITE MATERIALS CO., LTD., Shanghai (CN)

( * ) Notice: Subject to any disclaimer, the term of this patent is extended or adjusted under 35 U.S.C. 154(b) by 86 days.

(21) Appl. No.: 18/837,192

(22) PCT Filed: Jul. 29, 2022

(86) PCT No.: PCT/CN2022/109037
§ 371 (c)(1),
(2) Date: Aug. 9, 2024

(87) PCT Pub. No.: WO2023/151245
PCT Pub. Date: Aug. 17, 2023

(65) Prior Publication Data

US 2025/0163583 A1 May 22, 2025

(30) Foreign Application Priority Data

Feb. 11, 2022 (CN) ..... 202210129501.4

(51) Int. Cl.
*C23C 26/00* (2006.01)
*B24B 7/16* (2006.01)
(Continued)

(52) U.S. Cl.
CPC ..... *C23C 26/00* (2013.01); *B24B 7/16* (2013.01); *C22C 21/02* (2013.01); *C22C 32/0052* (2013.01)

(58) Field of Classification Search
CPC . C22C 32/0052; C22C 21/02; C22C 21/0416; B24B 7/16; C23C 26/00
See application file for complete search history.

(56) References Cited

U.S. PATENT DOCUMENTS 5,816,901 A * 10/1998 Sirany ..... B24B 5/065 451/63
6,598,716 B1 * 7/2003 Ihm ..... B23P 15/00 188/218 XL
2008/0093180 A1 4/2008 Pfister

FOREIGN PATENT DOCUMENTS

CN 100575520 12/2009
CN 107760894 3/2018
(Continued)

OTHER PUBLICATIONS

Lu Yizhong et al., "Friction and wear behavior of SiCp/Al composites dry sliding against GCr15 steel", Journal of Aeronautical Materials, Jun. 2008, submit with English abstract, pp. 87-92.
(Continued)

*Primary Examiner* — Nathan H Empie
(74) *Attorney, Agent, or Firm* — JCIPRNET

(57) ABSTRACT

The present invention relates to a method of surface friction treatment of a ceramic-reinforced aluminum matrix composite brake disc. By means of the surface friction treatment, a layer of restructured film is formed on a friction surface of the ceramic-reinforced aluminum matrix composite brake disc. Surface friction will form abrasive particles comprising aluminum alloy abrasive particles and ceramic abrasive particles on the friction surface, and an instantaneous high temperature generated during friction melts part of the
(Continued)

aluminum alloy abrasive particles and oxidizes a surface of part of the ceramic abrasive particles and the aluminum alloy abrasive particles, and meanwhile under friction force and pressure, the abrasive particles comprising the molten and softened aluminum alloy abrasive particles, ceramic abrasive particles, and their surface oxidation products are broken, mixed, extruded, and bonded to form a layer of restructured film.

5 Claims, 4 Drawing Sheets

(51) Int. Cl.
*C22C 21/02* (2006.01)
*C22C 32/00* (2006.01)

(56) References Cited

FOREIGN PATENT DOCUMENTS

| | | |
|---|---|---|
| CN | 110004387 | 7/2019 |
| CN | 110216365 | 9/2019 |
| CN | 111074109 | 4/2020 |
| CN | 112143921 | 12/2020 |
| CN | 111250698 | 1/2021 |
| CN | 112958903 | 6/2021 |
| CN | 114561641 | 5/2022 |
| JP | 2007113642 | 5/2007 |

OTHER PUBLICATIONS

Cui Gongjun et al., "Influence of modified phenolic resin on braking performance of friction disc" Mining & Processing Equipment, Jan. 2018, submit with English abstract, pp. 53-58.

"International Search Report (Form PCT/ISA/210) of PCT/CN2022/109037," mailed on Nov. 2, 2022, with English translation thereof, pp. 1-4.

"Written Opinion of the International Searching Authority (Form PCT/ISA/237) of PCT/CN2022/109037," mailed on Nov. 2, 2022, pp. 1-6.

"First Office Action of China Counterpart Application", issued on Feb. 20, 2023, pp. 1-6.

"Second Office Action of China Counterpart Application", issued on May 30, 2023, pp. 1-7.

* cited by examiner

METHOD OF SURFACE FRICTION TREATMENT OF CERAMIC-REINFORCED ALUMINUM MATRIX COMPOSITE BRAKE DISC

CROSS-REFERENCE TO RELATED APPLICATION

This application is a 371 of international application of PCT application serial no. PCT/CN2022/109037, filed on Jul. 29, 2022, which claims the priority benefit of China application no. 202210129501.4, filed on Feb. 11, 2022. The entirety of each of the above mentioned patent applications is hereby incorporated by reference herein and made a part of this specification.

FIELD OF TECHNOLOGY

The present invention relates to the technical field of brake discs of vehicles, and in particular to a method of surface friction treatment of a ceramic-reinforced aluminum matrix composite brake disc.

BACKGROUND

Lightweight is the developing trend of the global automobile industry, and it is crucial to reduce the weight of a vehicle; a brake disc as part of the unsprung mass of the vehicle and also a moment of inertia, reducing the weight of the automobile brake disc can not only reduce emissions and pollution, but also further reduce vibration and noise, and improve the controllability of the automobile and ride comfort, etc.

Currently, the existing automobile brake discs are cast iron discs, which have a larger mass.

A ceramic-reinforced aluminum matrix composite brake disc has the advantages of small density, light weight, fast heat dissipation, etc. The reinforcing material of ceramic in the ceramic-reinforced aluminum matrix composite brake disc belongs to ceramic materials, having high Mohs hardness, very low elongation at break, and high melting point; the aluminum alloy matrix has a low melting point (660° C.), is ductile and has a Mohs hardness of only 2-2.9; the performance difference between the two is very large, resulting in the friction mechanism of the ceramic-reinforced aluminum matrix composite brake disc is more complex than that of the cast iron disc, and thus it is particularly difficult to develop a matched automobile brake pad or urban rail brake pad for the ceramic-reinforced aluminum matrix composite brake disc.

Chinese patent CN111074109A has disclosed dual-phase ceramic particle reinforced aluminum matrix composites and brake drums and preparation methods thereof. The dual-phase ceramic particle reinforced aluminum matrix composite includes a reinforcement body, wherein the reinforcement body is the dual-phase ceramic particles comprising SiC particles and $TiB_2$ particles, the SiC particles accounting for 10-20 wt % of the total amount of the aluminum matrix composite, the $TiB_2$ particles accounting for 5-10 wt % of the total amount of the aluminum matrix composite, the $TiB_2$ particles with a particle size of 50-550 nm, in the provided dual-phase ceramic particle reinforced aluminum matrix composite silicon carbide and titanium diboride have good wettability and high bonding strength with the aluminum alloy, silicon carbide and titanium diboride are evenly distributed in the aluminum alloy matrix and densely organized, having superior properties such as high specific strength, high specific stiffness, high hardness, etc., thereby to produce the dual-phase ceramic particle reinforced aluminum matrix composite brake drum with excellent performance. But this patent does not involve microscopic surface morphology and surface energy issues of the ceramic particle reinforced aluminum matrix composite.

Chinese patent CN100575520C has disclosed an aluminum matrix composite containing aluminum, magnesium, copper alloys and a reinforcing phase of titanium boride, wherein the composite also contains a reinforcing phase of silicon carbide. The reinforcing phase of titanium boride and the reinforcing phase of silicon carbide in the provided aluminum matrix composite can be evenly distributed in and bonded with the aluminum matrix material, so that the tensile strength, the yield strength and the modulus of elasticity of the product obtained by die-casting molding of the aluminum matrix composite are substantially improved, thus to significantly improve the mechanical properties of the product. But this patent does not involve microscopic surface morphology and surface energy issues of the ceramic particle reinforced aluminum matrix composite.

Chinese patent CN111250698B has disclosed a lightweight wear-resistant aluminum matrix powder metallurgy composite rail transit brake disc and a preparation method thereof, comprising the following steps: 1) filling the wear-resistant aluminum matrix composite mixed powder into an annular disc-shaped mold, cold pressing and forming at room temperature, and demolding to obtain a rail transit brake disc blank; 2) sinter molding the rail transit brake disc blank to obtain a rail transit brake disc precursor; 3) placing the rail transit brake disc precursor in the hot-press shaping mold to be pressed and shaped, thereby to obtain a rail transit brake disc crude body; and 4) machining the rail transit brake disc crude body, wherein the machining as described the patent includes deburring, flying edges, and surface oxidation layer. The machining process is rough lathing. Rough lathing is a rough machining process in turning, and the surface after rough lathing is relatively rough and not capable of forming a restructured film.

Chinese patent CN107760894A has disclosed a method of preparing an aluminum matrix composite automobile brake disc, the steps of which include: 1) pretreatment of reinforcement particles; 2) composite fusion casting; and 3) machining and heat treatment. The heat-treated semi-finished product of the automobile brake disc in the patent is machined to the finished size to finally obtain the finished product of the aluminum matrix composite automobile brake disc. The purpose of machining in the patent is to machine to the finished size, and the machining in terms of dimensions does not involve improvement of the surface condition of the brake disc.

Chinese patent CN112958903A has disclosed a method of additive remanufacturing of an aluminum matrix composite brake disc, placing a cut additive part on a surface to be repaired of an old brake disc, after adjusting the relative position, fixing the old brake disc and the additive part, and welding processing the old brake disc and the additive part by friction stir welding to enable the old brake disc and the additive part to be welded together as a new brake disc. Specifically, it is further disclosed in the patent that during specific operation, the worn surface of the old brake disc is cut until the worn surface is flat, and then ground with a grinding wheel and a fiber wheel in turn to obtain the surface to be repaired as described above. After the old brake disc is worn by braking, the braking surface will generally be damaged and problems such as surface defects and fatigue will appear. By cutting and grinding the worn surface of the old brake disc, the defects and fatigue problems of the braking surface can be eliminated. The method of processing the corresponding additive parts comprises: measuring and calculating the wear size of the worn surface of the old brake disk, placing a material sheet in a lathe for rough machining, obtaining a rough additive material by cutting, and then grinding the rough additive material so that the size of the machined material sheet is consistent with the wear size to obtain the additive part. Meanwhile, after obtaining the new brake disc, the new brake disc needs to be cut with an allowance and ground to get a new brake disc that meets the size standard. Since the additive part leaves an allowance after cutting and grinding, a final cutting and grinding of the new brake discs is required to bring the size of the new discs up to standards after the welding is completed. The main purpose of grinding in Chinese patent CN112958903A is to bring the size of the new brake disc up to standards, and the patent reduces the size of the brake disc to meet the standards by taking substances away from the surface of the brake disc through grinding. Improvement in the surface properties of the brake disc is not involved.

As mentioned above, the existing surface of the ceramic-reinforced aluminum matrix composite brake disc is machined by lathing with artificial diamond cutting tools, because the lathing process is simple and efficient, lathing processing is generally used, the surface of ceramic-reinforced aluminum matrix composite brake disc is relatively rough after lathing processing, during friction between the ceramic-reinforced aluminum matrix composite brake disc and a brake pad, the aluminum alloy is easy to be worn and dented, ceramic particles or skeleton easily protrudes from the surface of the ceramic-reinforced aluminum matrix composite brake disc to achieve friction with the brake pad, and the brake pad can not contact the aluminum alloy on the surface of the ceramic-reinforced aluminum matrix composite brake disc or the contact area is very small, which therefore leads to very low coefficient of friction of the brake pad during friction, large wear loss, high temperature fade phenomenon, lack of recovery.

Therefore, how to improve the microscopic surface morphology, surface energy, and its surface friction treatment method of the surface of the ceramic-reinforced aluminum matrix composite brake disc is particularly important.

SUMMARY OF INVENTION

Based on the current state of prior art in which no attention has been paid to the surface morphology of a ceramic-reinforced aluminum matrix composite brake disc, the present invention provides a method of surface friction treatment of a ceramic-reinforced aluminum matrix composite brake disc.

The friction surface of the ceramic-reinforced aluminum matrix composite brake disc provided by the present invention forms a restructured film, and due to the presence of the restructured film, during friction between the surface of the ceramic-reinforced aluminum matrix composite brake disc and a brake pad, the restructured film directly rubs against the brake pad, and a chemical substance in the brake pad will generate a layer of stable and firm friction film on a surface of the restructured film. In this way, the friction between the friction surface of the ceramic-reinforced aluminum matrix composite brake disc and the brake pad is converted into the friction between the friction film and the brake pad, and the brake pad obtained by this processing method have the effects of maintaining stability of the coefficient of friction and resisting heat fade as tested in bench test.

The object of the present invention can be realized by the following technical solutions:

The present invention provides a method of surface friction treatment of a ceramic-reinforced aluminum matrix composite brake disc, comprising the following steps:

- forming a layer of restructured film on a friction surface of the ceramic-reinforced aluminum matrix composite brake disc by means of the surface friction treatment by using an abrasive tool as a tool;
- before the surface friction treatment, the morphology of the friction surface of the ceramic-reinforced aluminum matrix composite brake disc is as follows: with an aluminum alloy as a matrix, ceramic as a reinforcing material, and ceramic particles or skeletons dispersed in the aluminum alloy matrix;
- after the surface friction treatment, a layer of restructured film is formed on the friction surface of the ceramic-reinforced aluminum matrix composite brake disc,
- wherein the surface friction will form abrasive particles comprising aluminum alloy abrasive particles and ceramic abrasive particles on the friction surface, and an instantaneous high temperature generated during friction melts and softens part of the aluminum alloy abrasive particles and oxidizes a surface of part of the ceramic abrasive particles and the aluminum alloy abrasive particles, and meanwhile under friction force and pressure, the abrasive particles comprising the aluminum alloy abrasive particles, the ceramic abrasive particles, and their surface oxidation products are broken, mixed, extruded, and bonded to form a layer of restructured film which covers the entire surface of the brake disc to replace the original surface of the ceramic-reinforced aluminum matrix composite brake disc.

During formation of the restructured film, the aluminum alloy abrasive particles in molten and softened states play the role of binder for the formation of the restructured film.

The ceramic-reinforced aluminum matrix composite described in the present invention takes an aluminum alloy as a matrix, and the ceramic as a reinforcing material dispersed in the aluminum alloy matrix, and therefore before the surface friction treatment, in the friction surface of the ceramic-reinforced aluminum matrix composite brake disc, the ceramic is dispersed in the aluminum alloy matrix of the friction surface in the shape of particle or skeleton, and some sites of the ceramic are exposed to an outer face of the friction surface. This is also the problem existing in prior art highlighted in the background technology: the surface of ceramic-reinforced aluminum matrix composite brake disc is relatively rough, during friction between the ceramic-reinforced aluminum matrix composite brake disc and a brake pad, the aluminum alloy is easy to be worn and dented, the brake pad mainly rubs against the ceramic particle or skeleton protruding from the surface of the aluminum alloy matrix and can not contact the aluminum alloy on the surface of the ceramic-reinforced aluminum matrix composite brake disc or the contact area is very small, which causes the coefficient of friction low or unstable.

In the method of surface friction treatment of a ceramic-reinforced aluminum matrix composite brake disc provided by the present invention, the ceramic is selected from one or more of silicon carbide, titanium carbide, corundum, boron carbide, tungsten carbide, tantalum carbide, vanadium carbide or niobium carbide;

preferably, the ceramic is selected from silicon carbide.

In some embodiments of the present invention, there is no limitation on the proportion of the ceramic in the ceramic-reinforced aluminum matrix composite, and on the material of the aluminum alloy matrix, as long as the ceramic-reinforced aluminum matrix composite can be formed.

In some preferred embodiments of the present invention, a volume of the ceramic in the ceramic-reinforced aluminum matrix composite accounts for 10%-75%.

In one embodiment of the present invention, the preparation method of the ceramic-reinforced aluminum matrix composite brake disc can be selected from one of a powder metallurgy method, a stir casting method, a semi-solid molding method, a particle stirring method, a solid-state stirring method, a metal impregnation method, a laser melting method, an in-situ growth method, and a SiC skeleton casting method, etc., and preferably one of a powder metallurgy method, a stir casting method, and a SiC skeleton casting method.

In one embodiment of the present invention, a thickness of the restructured film is 1-5 μm. In one preferred embodiment, a thickness of the restructured film is 3.4 μm.

In one embodiment of the present invention, during friction between the ceramic-reinforced aluminum matrix composite brake disc and a brake pad, the restructured film directly rubs against the brake pad, a chemical substance in the brake pad will generate a layer of stable and firm friction film on a surface of the restructured film, and a thickness of the friction film is 2-10 μm.

In one embodiment of the present invention, a material of the brake pad to coordinate with the ceramic-reinforced aluminum matrix composite brake disc is selected to be an organically synthesized brake pad;

the material of the organically synthesized brake pad is selected from unmodified phenolic resins, modified phenolic resins, epoxy resins, bismaleimide resins, polyimide resins, amino resins, and nitrile-butadiene rubber modified resins; and the modified phenolic resins are selected from cashew nutshell oil-modified phenolic resins, cashew nutshell oil-melamine-modified phenolic resins, boron-modified phenolic resins.

In one embodiment of the present invention, the surface friction treatment is selected from one or more of surface grinding, external cylindrical grinding, internal cylindrical grinding, centerless grinding, free grinding or ring endface grinding.

The surface friction treatment described in the present invention can achieve the following effects by controlling the process of the surface friction treatment, although the existing grinding methods and equipments are used:

(1) Finally, the surface friction is repeated without blade feeding, for the purpose of generating a restructured film on the surface, and not for the purpose of grinding a substance away from the friction surface to achieve a machined size.

(2) An abrasive hardness of the selected abrasive tool is less than or equal to a Mohs hardness of the ceramic to reduce the wear on the generated restructured film, so that a speed of generating the restructured film is greater than a speed of wear, and the restructured film can be accumulated on the friction surface and reach a sufficient thickness.

(3) A surface energy of the restructured film is lower than that of the original surface of the ceramic-reinforced aluminum matrix composite brake disc, and physical and chemical properties of the surface are changed.

In one embodiment of the present invention, the surface friction treatment comprises the following step: repeating axial blade travel 2-10 times without blade feeding.

In one embodiment of the present invention, the surface friction treatment specifically comprises the following step:

(1) rough grinding: during the rough grinding, controlling a rotational speed of the abrasive tool at 1000-3500 r/min, upper and lower blade feeding amount of 0.01-0.03 mm, and the friction surface of the ceramic-reinforced aluminum matrix composite brake disc after the rough grinding having a surface roughness Ra≤2.000 μm;

(2) precision grinding: during the precision grinding, controlling a rotational speed of the abrasive tool at 1000-3500 r/min, upper and lower blade feeding amount of 0.001-0.01 mm, and the friction surface of the ceramic-reinforced aluminum matrix composite brake disc after the precision grinding having a surface roughness Ra≤1.000 μm;

(3) surface friction: repeating axial blade travel 2-10 times without blade feeding; and through the above 3 steps, the restructured film is obtained.

In one embodiment of the present invention, during rough grinding, precision grinding and surface friction, the ceramic-reinforced aluminum matrix composite brake disc is fixed to a workbench and a suitable abrasive tool is selected as a processing tool.

In one embodiment of the present invention, an abrasive hardness of the selected abrasive tool is less than or equal to a Mohs hardness of the ceramic.

In one embodiment of the present invention, the abrasive tool is mainly constituted by abrasives and binders. The types of abrasives used in the abrasive tool of the present application include a combination of abrasives of one or more of ordinary abrasives such as natural corundum, garnet, electrofused corundum, brown corundum, white corundum, monocrystalline corundum, microcrystalline corundum, chromium corundum, zirconium corundum, black corundum, half-crisp corundum, ceramic corundum, sintered corundum, silicon carbide (green silicon carbide, black silicon carbide, or cubic silicon carbide), boron carbide, hollow-ball abrasives, calcined abrasives, coat-plated abrasives, stacked abrasives, magnetic abrasives, and the like.

In one embodiment of the present invention, the abrasive tool is categorized into a consolidated abrasive tool and a coated abrasive tool, and the particle size mark of coarse particles in the ordinary abrasives of the consolidated abrasive tool used in the present application ranges from F4 to F220. In the abrasive micronized powder, the particle size mark of F series micronized powder is tested ranging from F230 to F2000 with a photoelectric sedimentometer and from F230 to F1200 tested with a settling tube particle size instrument, and the particle size mark of J series micronized powder is tested ranging from #240 to #8000 with a electrical resistance particle counter and from #240 to #3000 tested with a settling tube particle size instrument. Coarse abrasive particles of the abrasive particles of the coated abrasive tool have a particle size mark ranging from P12 to P220, and micronized powder has a particle size mark ranging from P240 to P2500. The particle size range of super-hard abrasives has a narrow range of particle size with an ISO particle size mark ranging from 1181 to 33, and a wide range with an ISO particle size mark ranging from 1182 to 252.

In one embodiment of the present invention, the binders of the abrasive tool include inorganic binders, such as ceramic binders (melted binders, low temperature binders and sintered binders), magnesia binders, metal binders (sintered metal binders, electroplated metal binders and brazing metal binders) and so on; and also include organic binders (resin binders, rubber binders and shellac binders). The binders of the coated abrasive tool include animal glue binders, semi-resin binders and full resin binders, etc.

In one embodiment of the present invention, types of the abrasive tool include, but are not limited to, grinding wheels, preferably using grinding wheels, and the type of grinding wheels can be selected as flat grinding wheels, cylindrical grinding wheels, single bevel edge grinding wheels, double bevel edge grinding wheels, single-sided concave grinding wheels, double-sided concave grinding wheels, cup-shaped grinding wheels, double cup grinding wheels, bowl-shaped grinding wheels, disc-shaped grinding wheels, saucer-shaped grinding wheels, single-sided cone grinding wheels, double-sided cone grinding wheels, single-sided concave single-sided cone grinding wheels, single-sided concave cone grinding wheels, double-sided concave single-sided cone grinding wheels, single-sided concave double-sided cone grinding wheels, double-sided concave cone grinding wheels, cymbal-shaped grinding wheels, tapered cymbal-shaped grinding wheels, disc grinding wheels for binding or clamping, bolted flat grinding wheels, bolted cylindrical grinding wheels, single-sided convex grinding wheels, double-sided convex grinding wheels, or single-sided convex and single-sided concave grinding wheels, and so on.

In one embodiment of the present invention, when the abrasive tool is not selected as grinding wheels, other consolidated abrasive tools include grinding heads (including but not limited to cylindrical grinding heads, hemispherical grinding heads, arc tapered grinding heads, spherical grinding heads, conical grinding heads, etc.), sand tiles, and a variety of specialized grinding wheels (including but not limited to heavy-duty grinding wheels, grinding ball grinding wheels, worm grinding wheels, deep cut slow-feeding grinding wheels, molding grinding wheels, centerless grinding wheels, cut-off grinding wheels, PVA grinding wheels, etc.). Also included are sand sheets, sand belts, sand discs (cloth gauze discs, paper sand discs, composite matrix sand discs, steel paper sand discs, sand discs with dust holes, adhesive backed sand discs, velvet backed sand discs, etc), sand sheet discs, sand sheet wheels (including general sand sheet wheels, sand sheet wheels with shafts, and sand sheet wheels with chucks) and the like of the coated abrasive tool.

The invention also provides a ceramic-reinforced aluminum matrix composite brake disc, wherein a friction surface of the ceramic-reinforced aluminum matrix composite brake disc forms a layer of restructured film, the restructured film is formed by breaking, mixing, extruding and bonding abrasive particles comprising molten and softened aluminum alloy abrasive particles, ceramic abrasive particles, and their surface oxidation products, and the layer of restructured film covers the entire surface of the brake disc to replace the original surface of the ceramic-reinforced aluminum matrix composite brake disc. It is easier to generate a stable and reliable friction film during friction with the brake pad, this friction film can replace the friction surface of the ceramic-reinforced aluminum matrix composite brake disc to rub against a brake pad, thus obtaining better and more stable friction performance.

In the ceramic-reinforced aluminum matrix composite brake disc provided by the present invention, the ceramic is selected from one or more of silicon carbide, titanium carbide, corundum, boron carbide, tungsten carbide, tantalum carbide, vanadium carbide or niobium carbide; and preferably, the ceramic is selected from silicon carbide.

In one embodiment of the present invention, a thickness of the restructured film is 1-5 μm.

In one embodiment of the present invention, during friction between the ceramic-reinforced aluminum matrix composite brake disc and a brake pad, the restructured film directly rubs against the brake pad, a chemical substance in the brake pad will generate a layer of stable and firm friction film on a surface of the restructured film, and a thickness of the friction film is 2-10 μm.

The invention provides a method of surface friction treatment of a ceramic-reinforced aluminum matrix composite brake disc. The present application uses the abrasives in the abrasive tool, with an abrasive hardness less than or equal to a Mohs hardness of the ceramic, later repeating 2-10 times without blade feeding, instead of taking substances away from the surface of the brake disc, through surface friction, abrasive particles comprising aluminum alloy abrasive particles and ceramic abrasive particles are formed on the friction surface, and an instantaneous high temperature generated during friction melts part of the aluminum alloy abrasive particles and oxidizes a surface of part of the ceramic abrasive particles and the aluminum alloy abrasive particles, and meanwhile under friction force and pressure, the abrasive particles comprising the molten and softened aluminum alloy abrasive particles, ceramic abrasive particles, and their surface oxidation products are broken, mixed, extruded, and bonded to form a layer of restructured film. This layer of restructured film covers the entire surface of the brake disc to replace the original surface of the ceramic-reinforced aluminum matrix composite brake disc. The purpose of the surface friction treatment in the present application is to reduce a surface energy of the friction surface, which is a property of the surface physicochemical category, rather than to grind to a geometric dimension. The surface of the ceramic-reinforced aluminum matrix composite brake disc treated with the method of the present invention is relatively flat and smooth, and a layer of restructured film is formed on the surface, due to the presence of this layer of restructured film, the surface energy of the ceramic-reinforced aluminum matrix composite brake disc is lowered, in coordination with an organically synthesized brake pad, and a relatively thick and strong friction film is formed on the friction interface. This layer of friction film can replace the friction surface of the ceramic-reinforced aluminum matrix composite brake disc to rub against a brake pad, thereby to increase the coefficient of friction, and maintain stability of the coefficient of friction, resist to heat fade and have excellent recovery performance.

Compared with the prior art, the present invention has the following beneficial effects:

(1) the existing ceramic-reinforced aluminum matrix composite brake disc due to the presence of ceramics currently generally uses a method of lathing processing with an artificial diamond cutting tool, and the method is a simple process and high efficiency. Grinding processing methods have also been used, but there has never been any concern about whether or not a thin film is formed on the machined surface, whether or not a thin film can be formed, or how to utilize this thin film. The present application uses a method of surface friction treatment, and based on the defined surface friction treatment process obtains a restructured film, and based on the restructured film, a desired friction film can be formed with the matched brake pad at the friction interface, changing the surface state of the ceramic-reinforced aluminum matrix composite brake disc.

(2) The present invention relates to a method of surface friction treatment of a ceramic-reinforced aluminum matrix composite brake disc, and the method of treatment breaks, mixes, extrudes, and binds abrasive particles comprising the molten and softened aluminum alloy abrasive particles, ceramic abrasive particles, and their surface oxidation products by means of friction force and pressure during friction to form a layer of restructured film. This layer of restructured film covers the entire surface of the brake disc to replace the original surface of the ceramic-reinforced aluminum matrix composite brake disc. When the restructured film replaces the surface of the ceramic-reinforced aluminum matrix composite brake disc to rub against a brake pad, a chemical substance in the brake pad will generate a layer of stable and firm friction film on a surface of the restructured film. The friction between the original surface of the ceramic-reinforced aluminum matrix composite brake disc and the brake pad is replaced by the friction between the friction film and the brake pad. It can not only improve the coefficient of friction, but also has the effects of maintaining stability of the coefficient of friction and resisting heat fade. Such a key technical solution enables the pair of friction between the ceramic-reinforced aluminum matrix composite brake disc and the matched automobile brake pad through the harsh test of AK-MASTER (SAE J2522) to be achieved, and enables the ceramic-reinforced aluminum matrix composite brake disc to gradually and completely replace the cast iron discs, thereby to truly realize lightweight.

Because the substances within the friction film are mainly originated from the brake pad, friction between similar substances enables the wear of the brake pad to be very low, the wear of the ceramic-reinforced aluminum matrix composite brake disc to be almost zero, without crack on the surface, to effectively protect the ceramic-reinforced aluminum matrix composite brake disc, and meanwhile to extend the service life of the automobile brake pads. Such a method of treatment enables the friction pair to have reliable friction performance and excellent wear resistance, and enables the service life of the ceramic-reinforced aluminum matrix composite brake disc to equal that of an automobile.

BRIEF DESCRIPTION OF THE DRAWINGS

The surface of the aluminum disc (i.e., a ceramic-reinforced aluminum matrix composite brake disc for short) was observed for its surface morphology with a high power microscope attached to a Vickers hardness tester with a magnification of 1200 times, as shown in FIGS. 1-10.

DESCRIPTION OF THE EMBODIMENTS

Figure 1:
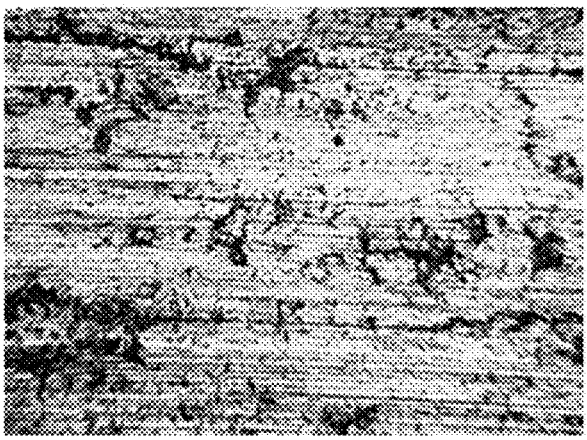
FIG. 1 is a surface topography of an aluminum disk after processing by the method of Comparative Example 2.

The invention is described in detail below in combination with the accompanying drawings and specific embodiments.

Example 1

The example provides a method of surface friction treatment of an aluminum disc, comprising the following steps:

(1) rough grinding: fixing the aluminum disc to a workbench, selecting a white corundum grinding wheel as an abrasive tool, during the rough grinding, controlling a rotational speed thereof at 2800 r/min, upper and lower blade feeding amount of 0.02 mm, and the aluminum disc after the rough grinding having a surface roughness Ra0.802 μm.

(2) precision grinding: fixing the aluminum disc to a workbench, controlling a rotational speed thereof at 2800 r/min, upper and lower blade feeding amount of 0.01 mm, and the aluminum disc after the precision grinding having a surface roughness Ra0.365 μm.

(3) surface friction: repeating axial blade travel 2 times without blade feeding.

Through the above 3 steps, the restructured film is obtained.

Example 2

The example provides a method of surface friction treatment of an aluminum disc, comprising the following steps:

(1) rough grinding: fixing the aluminum disc to a workbench, selecting a brown corundum grinding wheel as an abrasive tool, during the rough grinding, controlling a rotational speed thereof at 3200 r/min, upper and lower blade feeding amount of 0.02 mm, and the aluminum disc after the rough grinding having a surface roughness Ra0.864 μm.

(2) precision grinding: fixing the aluminum disc to a workbench, controlling a rotational speed thereof at 3200 r/min, upper and lower blade feeding amount of 0.008 mm, and the aluminum disc after the precision grinding having a surface roughness Ra0.330 μm.

(3) surface friction: repeating axial blade travel 4 times without blade feeding.

Through the above 3 steps, the restructured film is obtained.

Example 3

The example provides a method of surface friction treatment of an aluminum disc, comprising the following steps:

(1) rough grinding: fixing the aluminum disc to a workbench, selecting a green silicon carbide grinding wheel as an abrasive tool, during the rough grinding, controlling a rotational speed thereof at 1400/min, upper and lower blade feeding amount of 0.01 mm, and the aluminum disc after the rough grinding having a surface roughness Ra1.012 μm.

(2) precision grinding: fixing the aluminum disc to a workbench, controlling a rotational speed thereof at 1400 r/min, upper and lower blade feeding amount of 0.005 mm, and the aluminum disc after the precision grinding having a surface roughness Ra 0.452 μm.

(3) surface friction: repeating axial blade travel 3 times without blade feeding.

Through the above 3 steps, the restructured film is obtained.

Example 4

The example provides a method of surface friction treatment of an aluminum disc, comprising the following steps:

(1) rough grinding: fixing the aluminum disc to a workbench, selecting a black silicon carbide grinding wheel as an abrasive tool, during the rough grinding, controlling a rotational speed thereof at 3500 r/min, upper and lower blade feeding amount of 0.03 mm, and the aluminum disc after the rough grinding having a surface roughness Ra0.911 μm.

(2) precision grinding: fixing the aluminum disc to a workbench, controlling a rotational speed thereof at 3500 r/min, upper and lower blade feeding amount of 0.001 mm, and the aluminum disc after the precision grinding having a surface roughness Ra 0.501 μm.

(3) surface friction: repeating axial blade travel 5 times without blade feeding.

Through the above 3 steps, the restructured film is obtained.

Comparative Example 1

The comparative example provides a method of surface friction treatment of an aluminum disc, comprising the following steps:

(1) rough grinding: fixing the aluminum disc to a workbench, selecting an artificial diamond grinding wheel as an abrasive tool, during the rough grinding, controlling a rotational speed thereof at 3500 r/min, upper and lower blade feeding amount of 0.03 mm, and the aluminum disc after the rough grinding having a surface roughness Ra 1.206 μm.

(2) precision grinding: fixing the aluminum disc to a workbench, controlling a rotational speed thereof at 3500 r/min, upper and lower blade feeding amount of 0.005 mm, and the aluminum disc after the precision grinding having a surface roughness Ra 0.766 μm.

(3) Surface friction: repeating axial blade travel 5 times without blade feeding, no restructured film forming.

Comparative Example 2

The comparative example provides a method of lathe processing a surface of an aluminum disc, comprising the following steps:

(1) rough lathing: fixing the aluminum disc to a workbench, selecting an artificial diamond cutting tool as a processing tool, during rough processing, controlling a rotational speed thereof at 900 r/min, a blade feeding amount of 0.05 mm, and the aluminum disc after the rough grinding having a surface roughness Ra2.116 μm.

(2) precision lathing: fixing the aluminum disc to a workbench, controlling a rotational speed thereof at 900 r/min, a blade feeding amount of 0.005 mm, and the aluminum disc after the precision lathing having a surface roughness Ra 1.676 μm.

In the above examples and comparative examples, the composition of the aluminum disc comprises an aluminum alloy matrix and silicon carbide, by volume percentage, having the components and contents as follows: 25% silicon carbide particles, 75% aluminum alloy, in which by mass percentage, the components of the aluminum alloy are 9.0% silicon, 0.25% copper, 0.30% manganese, 0.20% magnesium, 0.6% iron, 0.30% nickel, 0.2% zinc, 0.02% lead, 0.005% tin, and the rest being aluminum. The aluminum disc was prepared by a stir casting method.

The aluminum discs were processed or treated by two different methods of lathing and surface friction, and the thickness, roughness and hardness of the surface films of the aluminum discs were tested respectively after processing or treatment, as shown in Table 1.

TABLE 1

Testing Data of the Surfaces of the Aluminum Discs after Processing or Treating

| | Surface Friction Treatment | | | | | Lathing Processing |
|---|---|---|---|---|---|---|
| | Example 1 | Example 2 | Example 3 | Example 4 | Comparative Example 1 | Comparative Example 2 |
| Measurements/μm | 10.6 | 10.4 | 10.1 | 9.9 | 7.5 | 7.2 |
| Thickness of Restructured Film/μm | 3.4 | 3.2 | 2.9 | 2.7 | / | / |
| Surface Roughness Ra/μm | 0.342 | 0.327 | 0.480 | 0.312 | 0.726 | 2.711 |
| Vickers Hardness/HV | 199 | 235 | 257 | 248 | 107 | 124 |

From the data, it can be seen that the surface of the aluminum disc through lathing processing is relatively rough and the surface of the aluminum disc through the surface friction treatment is relatively flat. The increase in film thickness after the surface friction treatment indicates the presence of a layer of restructured film on the surface of the aluminum disc after the treatment.

Therein, the testing methods for the restructured film thickness, surface roughness, Vickers hardness are:

the thickness of the restructured film, was measured with Model FMP40 film thickness gauge, during measuring, holding the probe sleeve, in the measurement, to maintain the vertical, stable, constant force of the probe to contact the surface of the aluminum disk, followed by a "tick" sound of the instrument, finishing the measurement to read out the measurement results.

Surface roughness, was measured with Model TR200 surface roughness instrument, correctly and stably placing the instrument on the surface of the aluminum disc, positioning the contact probein the center line for measurement, pressing the start measurement key for measurement, and reading out the measurement results at the end of measurement.

Vickers hardness, was measured with Model HV-1000Z automatic turret microhardness tester, during measurement pressing the top two opposing surfaces with a specified angle α (136°) of the positive four-pronged cone diamond indenter with a certain test force into the surface of the aluminum disk, holding for a specified period of time, after removal of the test force, the surface of the sample being pressed out an indentation having a square base and the same angle as the indenter, based on the surface area of the indentation, and calculating the Vickers hardness.

Figure 2:
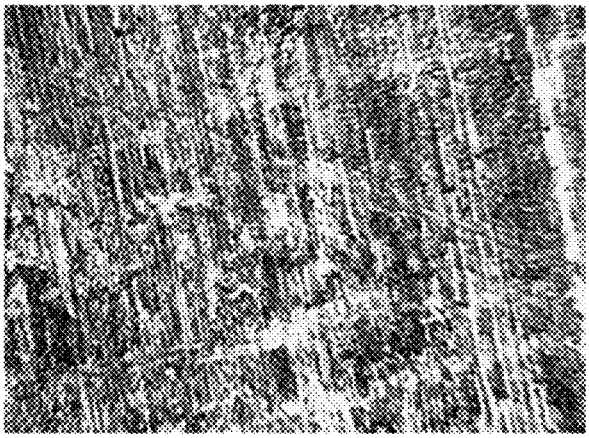
FIG. 2 is a surface topography of an aluminum disk after treating by the method of Example 1.

Aluminum discs were processed or treated by using two different methods of lathing (as in Comparative Example 2) and surface friction (as in Example 1), and after processing or treatment, and were respectively friction tested with automobile brake pads on an MM-1000 scale inertia dynamometer, and before and after the tests, the surface morphology thereof was observed by using a high power microscope attached to a Vickers hardness tester with a magnification of 1200 times, and the results were shown in FIGS. 1 and 2. As can be seen from FIG. 1 and FIG. 2, the surface of the aluminum disk through lathing processing has obvious grooves, the surface is uneven and relatively rough, without a restructured film; the surface of the aluminum disk after surface friction treatment has no groove, the surface is even and relatively flat and smooth, and forms a layer of restructured film.

Figure 3:
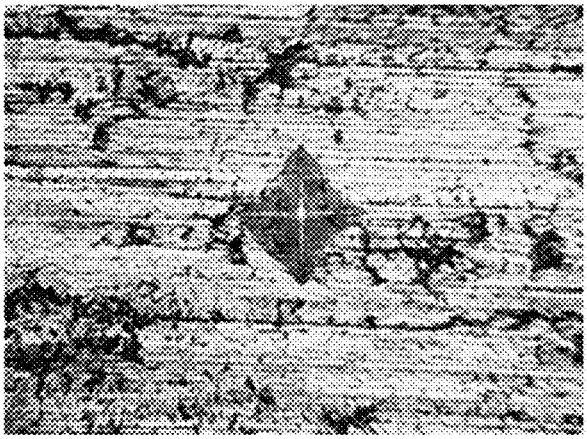
FIG. 3 is a surface topography of an aluminum disk after processing by the method of Comparative Example 2.
Figure 4:
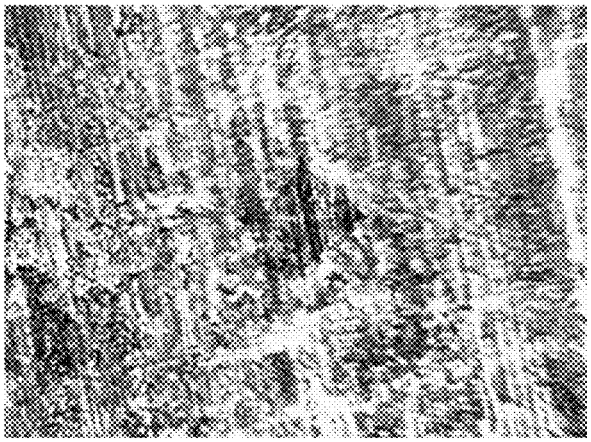
FIG. 4 is a surface topography of an aluminum disk after treating by the method of Example 1.

The hardness of the local position of the surfaces of the aluminum disks by lathing processing and surface friction treatment is shown in FIG. 3 and FIG. 4. A brighter region of the surface of the aluminum disk by lathing processing in FIG. 3 was selected to test the hardness with a Vickers hardness tester, the bright region had a plastic lathing pattern and softer HV124, which should be an aluminum alloy; the dark region was presumed to be a dimple left after peeling off brittle silicon carbide particles. As can be seen from FIG. 4, the surface friction treatment of the surface of the aluminum disk formed a layer of relatively even restructured film, which having a roughness significantly lower than that of the surface of the aluminum disk by lathing processing, a restructured film hardness of HV199, a moderate hardness, beneficial to the formation of friction film.

Aluminum discs were processed or treated by using two different methods of lathing (as in Comparative Example 2) and surface friction (as in Example 1), with which the matched automobile brake pads having exactly the same formulation process, the material of the brake pads being an organically synthesized brake pad of phenolic resins, the friction test was performed on an MM-1000 scale inertia dynamometer, after the test, the film thickness, roughness and hardness of the surface of the aluminum disc were determined, as shown in Table 2.

TABLE 2

Testing Data of the Aluminum Discs after Surface Friction

| | Surface Friction Treatment Example 1 | Lathing Processing Comparative Example 2 |
|---|---|---|
| Measurements/μm | 14.2 | 7.9 |
| Thickness of Restructured Film/μm | 3.4 | / |
| Thickness of Friction Film/μm | 3.6 | / |
| Surface Roughness Ra/μm | 0.389 | 1.025 |
| Vickers Hardness/HV | 267/252 | 184/2950 |

As can be seen from Table 2, after the test, the surface friction treatment of the surface of the aluminum disk increased the film thickness, indicating that after the friction reaction a layer of thick friction film was indeed generated; while the surface film of the aluminum disk by lathing processing was very thin and almost non-existent, and during friction between the aluminum disk by lathing processing and the automobile brake pad, the surface could not form a layer of continuous friction film and the friction film was very thin.

Figure 5:
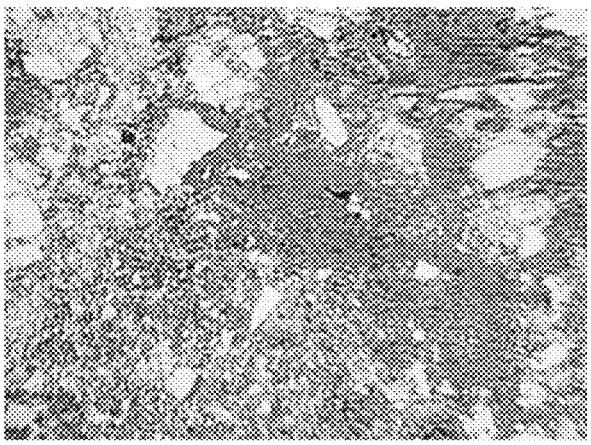
FIG. 5 is a surface topography of the aluminum disc after processing by the method of Comparative Example 2 and the brake pad after friction testing on MM-1000 scale inertia dynamometer.
Figure 6:
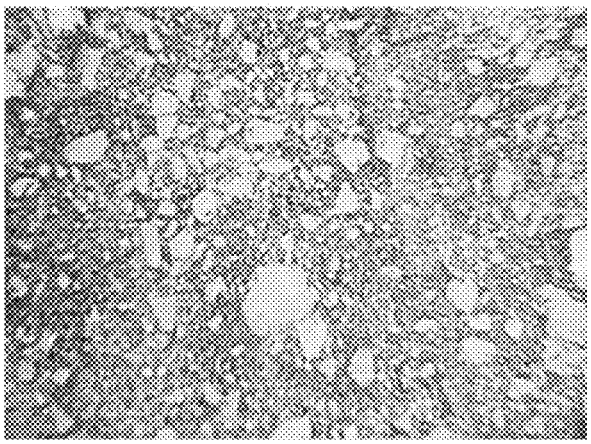
FIG. 6 is a surface topography of the aluminum disc after treating by the method of Example 1 and the brake pad after friction testing on MM-1000 scale inertia dynamometer.

The surface of the aluminum disk was observe at the end of the test. The results, as shown in FIGS. 5 and 6, showed that the bright white region and the dark region on the surface of the aluminum disk by lathing processing were more different, and there was a large bright white region. After the surface friction treatment, the microscopic bright white region of the friction surface was more scattered and mixed more evenly with the dark region. It was indicated that an even friction film was generated, after friction between the restructured film on the surface of the aluminum disc and the brake pad.

Figure 7:
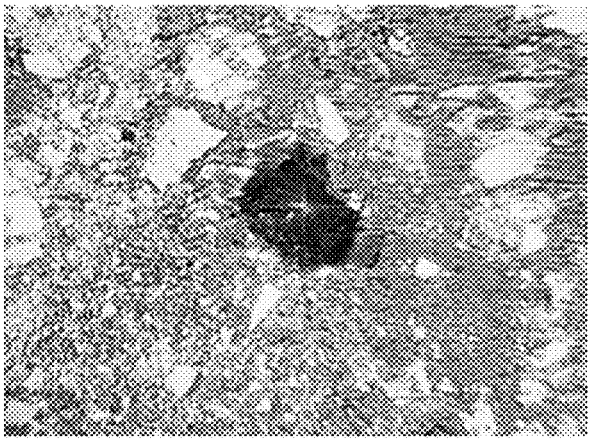
FIG. 7 is a surface topography 1 of the aluminum disc after processing by the method of Comparative Example 2 and the brake pad after friction testing on MM-1000 scale inertia dynamometer.
Figure 8:
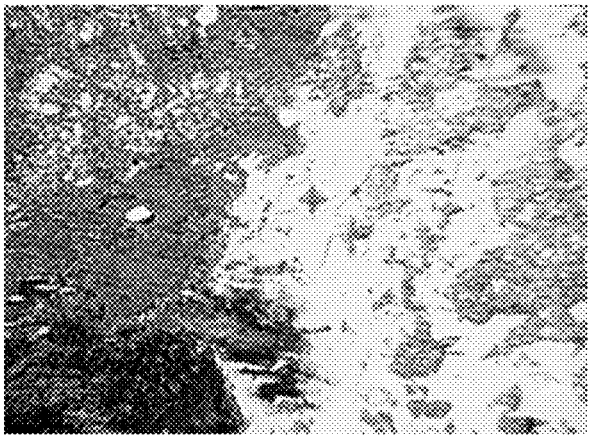
FIG. 8 is a surface topography 2 of the aluminum disc after processing by the method of Comparative Example 2 and the brake pad after friction testing on MM-1000 scale inertia dynamometer.

After testing the brake pads and the aluminum discs by lathing processing, the brighter region and the dark region in FIGS. 7 and 8 of the surface of the aluminum disc were selected to test the hardness of the large bright region of HV2950 with a Vickers hardness tester, the hardness being extremely high, presumably the bright region should be silicon carbide of a higher hardness, and the periphery of the indentation was clear and crackless, indicating that the region of silicon carbide was quite thick and large particles, and was the native silicon carbide particles of the surface of the aluminum disc, after the softer aluminum alloy at the periphery was worn, protruding from the friction surface, to form a large bright white region. The dark region had a hardness of HV184, which was supposed to be the aluminum alloy matrix and friction material of lower hardness. This indicated that the surface of Comparative Example 2 was still a discontinuous film layer after friction, with silicon carbide protruding to be the contact point with the brake pad, and thus the coefficient of friction was lower and unstable.

Figure 9:
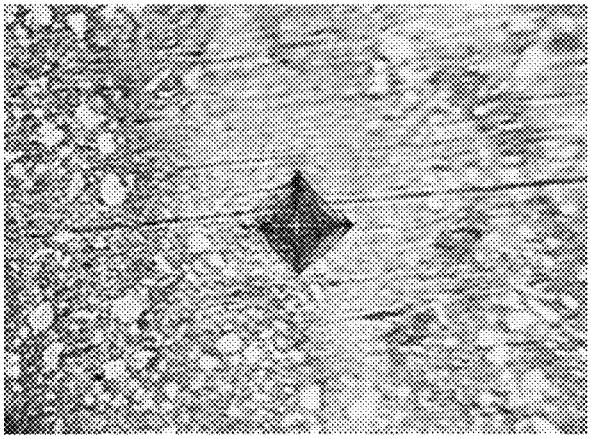
FIG. 9 is a surface topography 1 of the aluminum disc after treating by the method of Example 1 and the brake pad after friction testing on MM-1000 scale inertia dynamometer.
Figure 10:
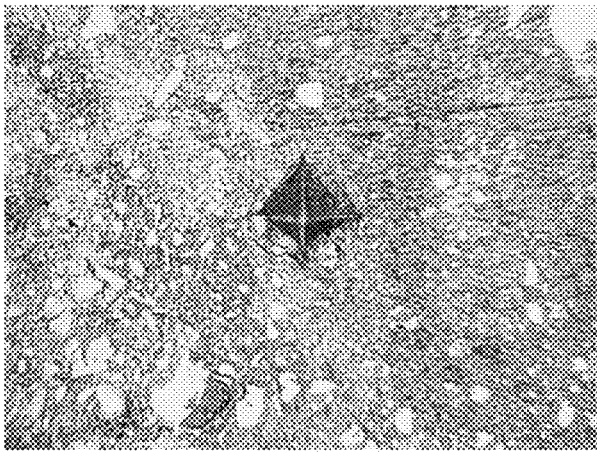
FIG. 10 is a surface topography 2 of the aluminum disc after treating by the method of Example 1 and the brake pad after friction testing on MM-1000 scale inertia dynamometer.

After testing automobile brake pads and the aluminum disc through surface friction treatment, the brighter region and the dark region of the surface of the aluminum disc in FIGS. 9 and 10 were selected to test the hardness with a Vickers hardness tester, for the bright region HV267 and the dark region HV252, the hardness was relatively close, indicating that after the friction reaction, on the surface of the aluminum disc has been formed a continuous layer of friction, which can also confirm that the restructured film after surface friction treatment can form a friction film during friction.

The surface of the aluminum disc used a method of surface friction treatment, as described in Examples 1-4 and Comparative Example 1, with which the matched automobile brake pads having exactly the same formulation process, the material of the brake pads being an organically synthesized brake pad of phenolic resins, the surface of the aluminum disc used a method of lathing processing with an artificial diamond cutting tool, as described in Comparative Example 2, and the friction test was performed on an MM-1000 scale inertia dynamometer, after processing, respectively with the brake pads, at a test pressure 90 bar. The testing results were shown in Table 3.

TABLE 3

Testing Data of the Surfaces of the Aluminum Discs on an MM-1000 Scale Inertia Dynamometer

| Speed/km/h | Example 1 | Example 2 | Example 3 | Example 4 | Comparative Example 1 | Comparative Example 2 |
|---|---|---|---|---|---|---|
| 90 | 0.410 | 0.376 | 0.371 | 0.385 | 0.371 | 0.341 |
| 160 | 0.357 | 0.366 | 0.339 | 0.401 | 0.358 | 0.301 |
| 200 | 0.344 | 0.362 | 0.332 | 0.341 | 0.329 | 0.236 |
| 90 | 0.585 | 0.562 | 0.521 | 0.447 | 0.390 | 0.235 |
| 160 | 0.463 | 0.420 | 0.412 | 0.381 | 0.390 | 0.239 |
| 200 | 0.329 | 0.359 | 0.314 | 0.304 | 0.315 | 0.218 |
| 90 | 0.583 | 0.490 | 0.529 | 0.473 | 0.333 | 0.223 |
| Mass Wear of Brake Pad/g | 0.329 | 0.431 | 0.401 | 0.387 | 0.653 | 1.029 |
| Thickness Wear of Brake Pad/mm | 0.685 | 0.655 | 0.955 | 0.740 | 1.335 | 1.521 |
| Mass Wear of Aluminum Disc/g | 0 | 0 | 0 | 0 | 0.001 | 0.001 |
| Surface of Brake Pad After Testing | Crackless | Crackless | Crackless | Crackless | Crackless | Crackless |
| Surface of Aluminum Disc After Testing | Smooth, Crackless | Smooth, Crackless | Smooth, Crackless | Smooth, Crackless | Smooth, Crackless | Smooth, Crackless |

In Table 3, the data corresponding to the rows following the speeds (km/h) of 90, 160, 200, 90, 160, 200, 90 are the coefficients of friction of the corresponding examples and comparative examples. In Table 3, the coefficients of friction of the examples and the comparative examples were measured multiple times at speeds (km/h) of 90, 160, 200, 90, 160, 200, 90, respectively, and these are set testing procedures, wherein a second group of 90 km/h, 160 km/h, 200 km/h and a third group of 90 km/h were tested for the recovery performance of the surface of the aluminum disk after high-speed friction. The second 90 km/h, 160 km/h, 200 km/h and the third 90 km/h were used to check the recovery performance of the aluminum disc surface after high speed friction.

The surface of the aluminum disc used a method of surface friction treatment, as described in Examples 1-4, and after the aluminum disc was tested with an automobile brake pad, the brake pad had a high and stable coefficient of friction and good recovery performance. Comparative Example 1 (surface friction treatment with an artificial diamond grinding wheel), the brake pad had a low coefficient of friction and poor recovery performance, as can be seen, after the aluminum disc through surface friction treatment with an abrasive tool having an abrasive hardness less than or equal to that of silicon carbide, the brake pad had a high coefficient of friction and better recovery after testing. Comparative Example 2 (lathing processing with an artificial diamond cutting tool), the brake pad had a low coefficient of friction and very poor recovery performance. The surface of the brake pads in both processing methods was crackless, and the aluminum discs were smooth and crackless.

In view of the relatively ideal results of the MM-1000 scale inertia dynamometer test, the AK-MASTER (SAE-J2522) 1:1 bench test was carried out for verification. The surface of the aluminum disc used a method of surface friction treatment with a white corundum grinding wheel, as described in Example 1, with which the matched automobile brake pads having exactly the same formulation process, the material of the brake pads being an organically synthesized brake pad of phenolic resins, the surface of the aluminum disc used a method of lathing processing with an artificial diamond cutting tool, as described in Comparative Example 2, and the friction test was performed on an AK-MASTER (SAE-J2522) 1:1 bench, after processing, respectively with the brake pads, the testing results being shown in Tables 4 and 5.

TABLE 4

Data of the Aluminum Discs in 1:1 Bench Coefficient of Friction Testing

| AK-Master | Example 1 | | Comparative Example 2 | |
|---|---|---|---|---|
| Chapter No. of Testing | Avg. | Min. | Avg. | Min. |
| 6.1 | 0.34 | | 0.31 | |
| 6.2 | 0.35 | | 0.35 | |
| 6.3 | 0.37 | | 0.34 | |
| 6.4.1 | 0.42 | | 0.33 | |
| 6.4.2 | 0.36 | | 0.35 | |
| 6.4.3 | 0.33 | | 0.33 | |
| 6.4.4 | 0.32 | | 0.27 | |
| 6.4.5 | 0.32 | | 0.22 | |
| 6.5 | 0.33 | | 0.27 | |

TABLE 4-continued

| Data of the Aluminum Discs in 1:1 Bench Coefficient of Friction Testing | | | | |
|---|---|---|---|---|
| AK-Master | Example 1 | | Comparative Example 2 | |
| Chapter No. of Testing | Avg. | Min. | Avg. | Min. |
| 6.6 | 0.37 | | 0.33 | |
| 6.7 | 0.34 | | 0.26 | |
| 6.8 | 0.35 | | 0.29 | |
| 6.9 | 0.34 | 0.26 | 0.27 | 0.22 |
| 6.10 | 0.32 | | 0.24 | |
| 6.11 | 0.34 | | 0.25 | |
| 6.12.1 | 0.34 | | 0.21 | |
| 6.12.2 | 0.23 | 0.18 | 0.17 | 0.14 |
| 6.13 | 0.34 | | 0.26 | |
| 6.14 | 0.27 | 0.21 | 0.15 | 0.10 |
| 6.15 | 0.34 | | 0.26 | |

In Table 4, 6.1, 6.2, 6.3, etc. in the first column indicate the different testing chapter numbers of the AK-MASTER (SAE-J2522) 1:1 bench, and different testing chapter numbers correspond to slightly different testing standards, the coefficients of friction of the aluminum discs were measured under different testing chapter numbers, and the minimum coefficients of friction were not required under some testing chapter numbers, and therefore under some testing chapter numbers the minimum coefficient of friction (Min.) is empty.

TABLE 5

| Testing Data of Aluminum Disc 1:1 Bench | | | | | | | | |
|---|---|---|---|---|---|---|---|---|
| Test Item | Example 1 | | | | Comparative Example 2 | | | |
| Mass Wear of Brake Pad/g | Internal Test | 3.5 | External Test | 3.5 | Internal Test | 6.2 | External Test | 8.3 |
| Thickness Wear of Brake Pad/μm | Internal Test | 0.270 | External Test | 0.282 | Internal Test | 0.492 | External Test | 0.735 |
| Mass Wear of Aluminum Disc/g | 0 | | | | 0.8 | | | |
| Surface of Brake Pad After Testing | Crackless | | | | Crackless | | | |
| Surface of Aluminum Disc After Testing | Smooth, Crackless | | | | Smooth, Crackless | | | |
| Thickness of Restructured Film/μm | 3.2 | | | | / | | | |
| Thickness of Friction Film/μm | 5.2 | | | | / | | | |
| Before Testing Aluminum Disc Surface Roughness Ra/μm | 0.325 | | | | 2.643 | | | |
| After Testing Aluminum Disc Surface Roughness Ra/μm | 0.354 | | | | 1.230 | | | |

As can be seen from Table 4, the surface of the aluminum disc used a method of surface friction treatment, as described in Examples 1, and after the aluminum disc was tested with an automobile brake pad, the brake pad had a high and stable coefficient of friction and good recovery performance. The surface of the aluminum disc used a method of lathing processing, as described in Comparative Example 2, and after the aluminum disc was tested with an automobile brake pad, the brake pad had a low coefficient of friction and very poor recovery performance. As can be seen from Table 5, the surface of the aluminum disc used a method of surface friction treatment, there exists a layer of restructured film on the surface of the aluminum disc, and a layer of friction film was generated on the surface of the aluminum disc after 1:1 bench test. The surface of the aluminum disc used a method of lathing processing, the surface of the aluminum disc could not form a layer of restructured film, and after 1:1 bench test, the surface of the aluminum disc could not form a layer of continuous friction film and the friction film was very thin. The surface of the aluminum disc used a method of surface friction treatment, the wear of the brake pad was low, and the aluminum disc had no wear. The surface of the brake pads in both processing methods was crackless, and the aluminum discs were smooth and crackless.

It should be noted that the above examples and comparative examples are given only for the treatment of aluminum discs of a specific composition, and the method using the present invention can also be applied to a variety of other silicon carbide-reinforced aluminum matrix composite brake discs, in addition to the specific disc composition given in the examples and comparative examples. e.g., the composition of the silicon carbide-reinforced aluminum matrix composite brake disc comprises an aluminum alloy matrix and silicon carbide, by volume percentage, having the components and contents as follows: 20-30% silicon carbide particles, 70-80% aluminum alloy, in which by mass percentage, the components of the aluminum alloy are: silicon 8.0-10.5%, copper≤0.3%, manganese≤0.2-0.5%, magnesium 0.17-0.30%, iron≤1.0%, nickel≤0.50%, zinc≤0.40%, lead≤0.05%, tin≤0.01%, and the rest being aluminum.

Furthermore, in addition that the method of the present invention can be applied to a ceramic-reinforced aluminum matrix composite brake disc having silicon carbide as the ceramic material, according to the technical solution of the present application, for the ceramic-reinforced aluminum matrix composite brake disc, a layer of restructured film can be likewise formed on the surface of the ceramic-reinforced aluminum matrix composite brake disc by adopting the method of surface friction treatment provided by the present invention when the ceramic is selected from corundum or other materials.

The foregoing description of examples is intended to facilitate the understanding and use of the invention by persons of ordinary skill in the art. A person skilled in the art can obviously easily make various modifications to these examples and apply the general principles illustrated herein to other examples without having to go through creative labor. Therefore, the present invention is not limited to the above examples, and improvements and modifications made by persons skilled in the art in accordance with the disclosure of the present invention without departing from the scope of the present invention should be within the scope of protection of the present invention.

What is claimed is:

1. A method of surface friction treatment of a ceramic-reinforced aluminum matrix composite brake disc, characterized by comprising the following steps:

forming a layer of restructured film on a friction surface of the ceramic-reinforced aluminum matrix composite brake disc by means of the surface friction treatment by using an abrasive tool as a tool, wherein an abrasive hardness of the selected abrasive tool is less than or equal to a Mohs hardness of a ceramic in the ceramic-reinforced aluminum matrix composite brake disc;

the surface friction treatment comprises the following steps:

(1) rough grinding: during the rough grinding, controlling a rotational speed of the abrasive tool at 1000-3500 r/min, upper and lower abrasive tool feeding amount of 0.01-0.03 mm, and the friction surface of the ceramic-reinforced aluminum matrix composite brake disc after the rough grinding having a surface roughness Ra≤2.000 μm;

(2) precision grinding: during the precision grinding, controlling a rotational speed of the abrasive tool at 1000-3500 r/min, upper and lower abrasive tool feeding amount of 0.001-0.01 mm, and the friction surface of the ceramic-reinforced aluminum matrix composite brake disc after the precision grinding having a surface roughness Ra≤1.000 μm;

(3) surface friction: repeating axial abrasive tool travel 2-10 times without abrasive tool feeding; and through the above 3 steps, the restructured film is obtained;

wherein the surface friction treatment forms abrasive particles comprising aluminum alloy abrasive particles and ceramic abrasive particles on the friction surface, and an instantaneous high temperature generated during friction melts part of the aluminum alloy abrasive particles and oxidizes a surface of part of the ceramic abrasive particles and the aluminum alloy abrasive particles, and meanwhile under friction force and pressure, the abrasive particles comprising the molten and softened aluminum alloy abrasive particles, the ceramic abrasive particles, and their surface oxidation products are broken, mixed, extruded, and bonded to form the restructured film which covers the entire surface of the ceramic-reinforced aluminum matrix composite brake disc to replace an original surface of the ceramic-reinforced aluminum matrix composite brake disc;

a thickness of the restructured film is 1-5 μm;

wherein during friction between the ceramic-reinforced aluminum matrix composite brake disc and a brake pad, the restructured film directly rubs against the brake pad, a chemical substance in the brake pad generates a layer of a friction film on a surface of the restructured film.

2. The method of surface friction treatment of the ceramic-reinforced aluminum matrix composite brake disc according to claim 1, characterized in that the ceramic is selected from one or more of silicon carbide, titanium carbide, corundum, boron carbide, tungsten carbide, tantalum carbide, vanadium carbide or niobium carbide.

3. The method of surface friction treatment of the ceramic-reinforced aluminum matrix composite brake disc according to claim 2, characterized in that the ceramic is selected from silicon carbide.

4. The method of surface friction treatment of the ceramic-reinforced aluminum matrix composite brake disc according to claim 1, characterized in that a volume of the ceramic in the ceramic-reinforced aluminum matrix composite accounts for 10%-75%.

5. The method of surface friction treatment of the ceramic-reinforced aluminum matrix composite brake disc according to claim 1, characterized in that a material of the brake pad to coordinate with the ceramic-reinforced aluminum matrix composite brake disc is selected to be an organically synthesized brake pad;

the material of the organically synthesized brake pad is selected from unmodified phenolic resins, modified phenolic resins, epoxy resins, bismaleimide resins, polyimide resins, amino resins, and nitrile-butadiene rubber modified resins; and the modified phenolic resins are selected from cashew nutshell oil-modified phenolic resins, cashew nutshell oil-melamine-modified phenolic resins, and boron modified phenolic resins.

* * * * *